United States Patent [19]

Voegelin

[11] 4,137,841

[45] Feb. 6, 1979

[54] LOW INERTIA SCREEN INTERRUPT MOUNT

[75] Inventor: Heinrich Voegelin, Wiler near Utzenstorf, Switzerland

[73] Assignee: Fritz Buser Ag. Maschinenfabrik, Switzerland

[21] Appl. No.: 786,362

[22] Filed: Apr. 11, 1977

[30] Foreign Application Priority Data

Apr. 12, 1976 [SE] Sweden ..... 764617

[51] Int. Cl.[2] ..... B41F 15/38; B41F 15/10

[52] U.S. Cl. ..... 101/128.1; 101/115

[58] Field of Search ..... 101/115, 116, 127.1, 101/126, 128.1, 120, 184, 185, 191, 192, 247

[56] References Cited

U.S. PATENT DOCUMENTS

| | | | |
|---|---|---|---|
| 2,928,340 | 3/1960 | Stein et al. | 101/116 X |
| 3,565,002 | 2/1971 | Boehm | 101/116 |
| 3,675,571 | 7/1972 | Vertegaal | 101/115 |
| 3,834,309 | 9/1974 | Zimmer | 101/115 |
| 3,892,177 | 7/1975 | Giani | 101/127.1 X |
| 3,946,667 | 3/1976 | Mallofre | 101/126 X |
| 3,960,076 | 6/1976 | Wick | 101/120 X |

*Primary Examiner*—Ronald E. Suter

*Attorney, Agent, or Firm*—Roylance, Abrams, Berdo & Farley

[57] ABSTRACT

A rotary screen process printing press has a plurality of printing stations, each having a pair of first and second transverse bars and a cylindrical stencil which is movably and adjustably supported between each pair of bars. The drive shafts for rotating the stencils are mounted in the first bars. The ends of each stencil are provided with bearing plates or head bearings. One end of each bearing plate is coupled to a first bar so as to pivot about the longitudinal axis of its drive shaft. The other end of each bearing plate has a mechanism to lift or lower the bearing plate to cause it to pivot about its shaft axis so that a stencil may be moved relative to the material being printed without moving its drive shaft. The lifting mechanisms and the pivotable coupling are adjustably attached to the bars to permit the position of the stencil to be varied.

5 Claims, 3 Drawing Figures

LOW INERTIA SCREEN INTERRUPT MOUNT

In a known rotary screen process printing press the interruption of contact between the stencil and the material to be printed is brought about by raising the entire mechanism. In this context, the term printing mechanism is understood to include the printing mechanism drive, the two head bearings with the stencil and the transverse bar or bars. Since the printing mechanism constitutes a relatively large mass, correspondingly large inertia forces have to be controlled when it is moved.

In another known rotary screen process printing press the interruption between contact of the stencil and the material to be printed is accomplished by pivoting the printing mechanism. Since the drive is not also moved this solution leads to a detectable reduction in the inertia forces. In a similar known construction the transverse bar is constructed as a square tube which is pivotable about an eccentrically arranged pivot axis. However, these two known types of presses use only a single transverse bar to support the head bearings. The disadvantage in using only a single transverse bar is that the head bearings are deformed to a greater extent when the stencil is axially stressed since the head bearings are supported on only one side.

BRIEF DESCRIPTION OF THE INVENTION

An object of the present invention is to provide a rotary screen printing press capable of interrupting the contact between the stencil and the material to be printed in which the number of parts to be moved is reduced and in which the drive mechanism is located outside the area of possible leaking ink. In particular, it is the object of the present invention to mount the cylindrical stencil between a pair of transverse bars by a pair of head bearings which are pivotably connected to the transverse bar containing the drive means at one end and coupled to the other transverse bar by means which will selectively pivot the stencil about the drive means at the other end.

Briefly described, the invention includes a rotary screen process printing press having at least one printing station comprising a machine frame, a conveyor belt supported on the frame for carrying material to be printed, first and second transverse bars at the printing station fixedly secured to the frame above the belt, a driving shaft rotatably mounted in the first transverse bar to rotate therein about its longitudinal axis, a cylindrical stencil provided between the first and second bars, a bearing plate mounted on each end of the stencil, first means for coupling one end of each bearing plate to the first bar to permit each bearing plate to pivot about the shaft axis, a second means for coupling the other end of each bearing plate to the second bar to raise and lower the other end of each bearing plate selectively to enable the stencil to be moved toward or away from the material to be printed to interrupt contact between the stencil and the material to be printed by pivotable movement of the bearing plates about the shaft axis upon actuation of the second means, and driving means in one of the bearing plates for coupling the stencil to the driving shaft to permit the driving shaft to rotate the stencil synchronously with the belt and to axially stress the stencil.

In order that the manner in which the foregoing and other objects are attained in accordance with the invention can be understood in detail, particularly advantageous embodiments thereof will be described with reference to the accompanying drawings, which form a part of this specification:

Figure 1:
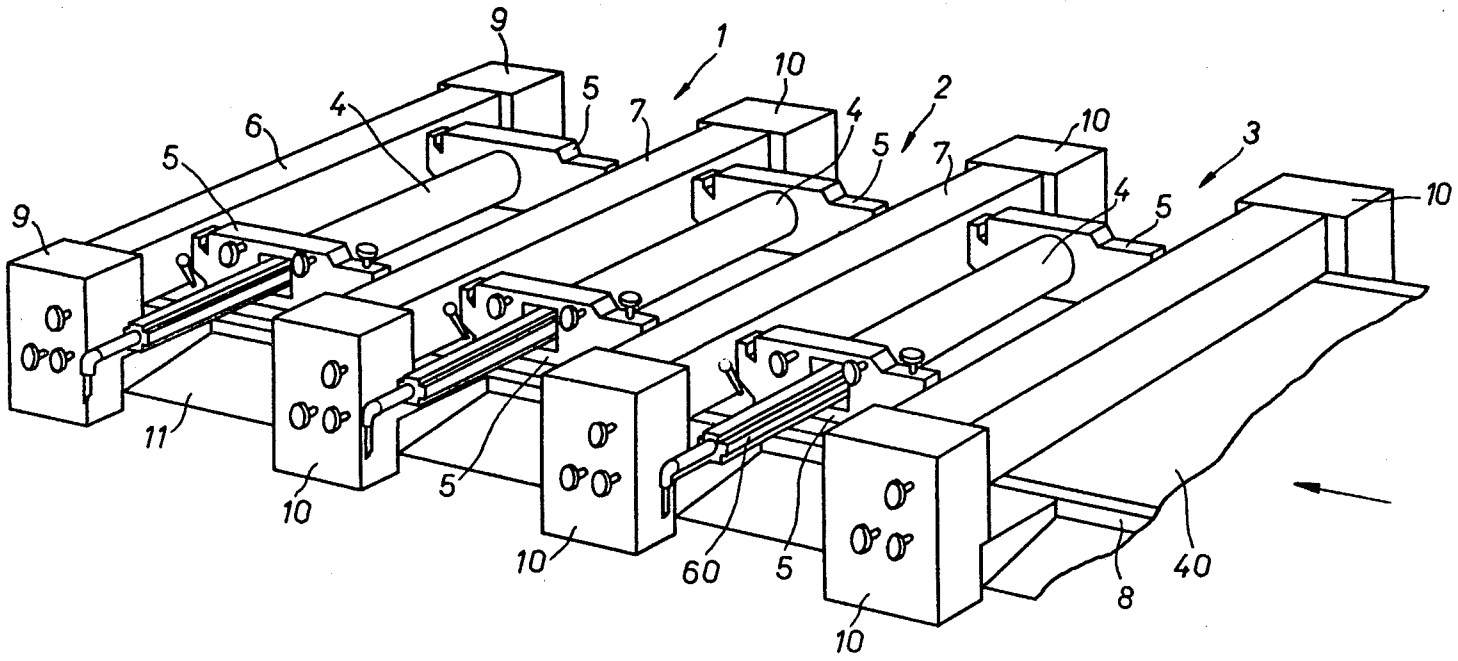
FIG. 1 is a schematic perspective view of a rotary screen process printing press according to one embodiment of the present invention.

FIG. 1 shows a plurality of printing stations 1, 2, 3 of a rotary screen process printing press. Each of the printing stations 1, 2, 3 comprises a cylindrical stencil 4 mounted at both its ends in head bearings or bearing plates 5. Head bearings or bearing plates 5 are mounted in transverse bars 6, 7, which are firmly supported on the machine frame 8. Each printing station 1, 2, 3 has at least one drive located in housings 9, 10 arranged on machine frame 8 to rotate stencil 4. The necessary operating means are also arranged in the housings 9, 10.

Transverse bars 7 are constructed in such a way that together with the two associated head bearings 5 they can effect a pivotable movement for adjusting the diagonal ratio.

It is important that in one of the transverse bars 6, 7 head bearings 5 can be rotated about a horizontal axis and can perform a pivotal movement relative to fixed transverse bars 6, 7 to enable stencil 4 to be raised and lowered. The raising and lowering device is described in detail relative to FIG. 2. Trays 11 are arranged below head bearings 5 and are able to carry off any ink which leaks out of the stencil.

Figure 2:
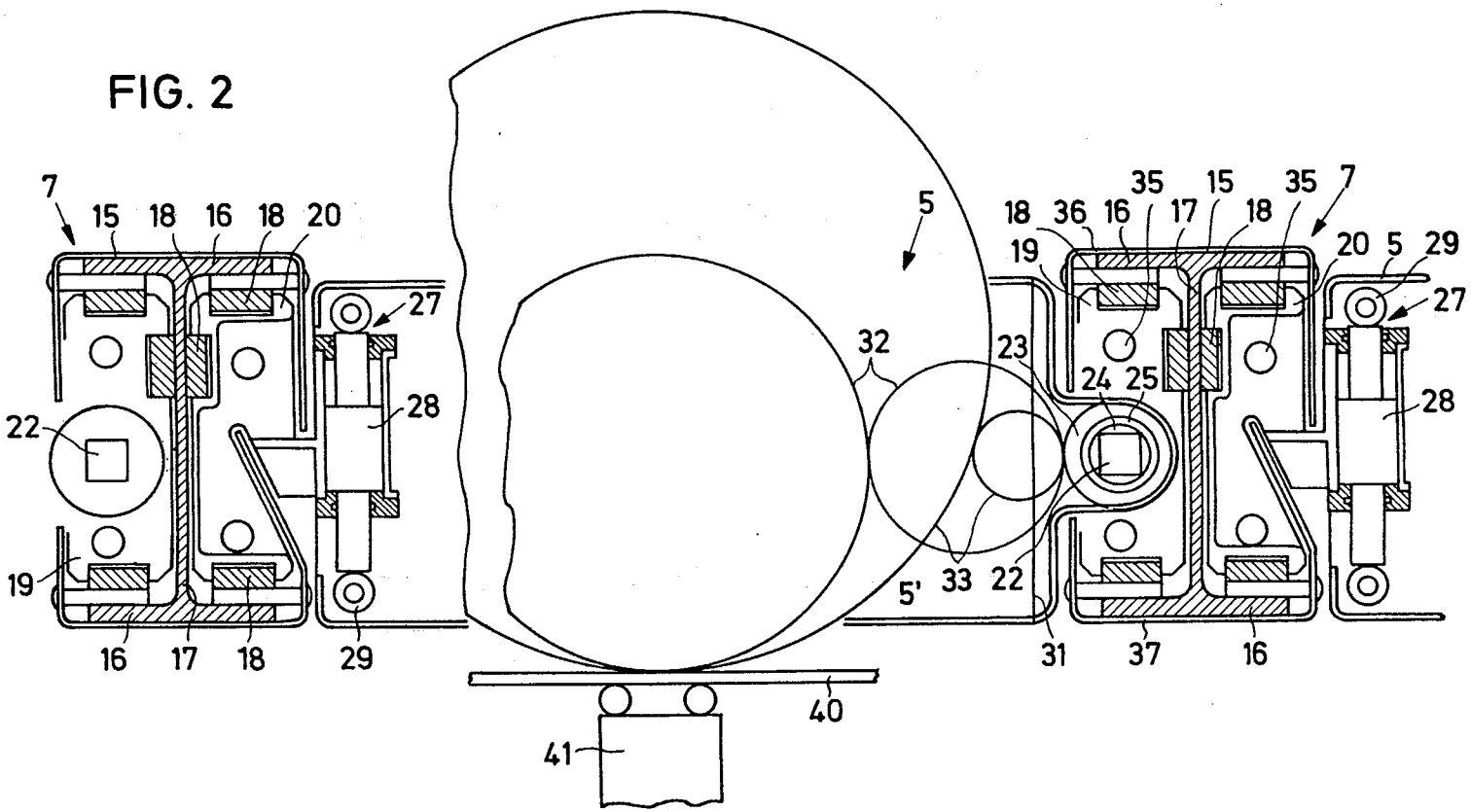
FIG. 2 is a schematic cross-sectional view of the embodiment of FIG. 1.

FIG. 2 shows a vertical section through the two transverse bars 7 and the intermediate, schematically indicated head bearing 5. Each transverse bar 7 is constructed as a double T section 15. Guide strips 18 are fixed to the inside of arms 16 and to legs 17 of sections 15. The slides 19, 20 are guided and shiftable in guide strips 18.

A driving shaft 22 constructed as a square tube extends the entire length of the transverse bar. A gear wheel 23 is mounted on a shaft 22. A cylindrical portion 24 is arranged on each side of gear wheel 23 and serves on the one hand for the mounting in slide 19 and on the other carries a bearing 25 arranged in head bearing 5. As a result of this arrangement, the driving shaft 22 only has to absorb torsional moments, but not bending stresses.

Slide 20 in the other part of transverse bar 7 carries a thrust piston drive 27. The piston 28 acts via rollers 29 on the other end of head bearing 5 and on actuation gives the head bearing a lifting movement so that it is pivoted about the axis of driving shaft 22. It is also possible to use an electrical or mechanical (eccentric) lifting mechanism in place of thrust piston drive 27. Each head bearing 5 is thus supported on one side on the shaft 22 and on the other side on thrust piston drive 27. Since cylindrical stencils 4 with different diameters may be used on the press, in each case corresponding head bearings 5 must be employed. To this end it is advantageous for the head bearing 5 not to be in one part but in three parts, so that on changing to a stencil of a different diameter it is only necessary to replace the central portion 5' with the mounting for the stencil 4. In FIG. 2 the separation of central portion 5' takes place between piston 28 of lifting mechanism 27 and the guide rollers 29 mounted in central portion 5' as well as along line 31 on the driving side. At the separation points corresponding connecting means, e.g. dovetail guides, connecting bolts, etc., are provided.

The pair of gear wheels 32 or 33 mounted in central portion 5' serves to transfer the driving torque from shaft 22 to stencil 4. The pair of wheels 32 meshes with the gear wheel 23 driven by driving shaft 22 when using a smaller diameter stencil. The pair of wheels 33 meshes with the gear wheel 23 driven by driving shaft 22 when using a larger diameter stencil. The head bearing supported in slides 19 and 20 may be displaced parallel to the transverse bar. The spindles 35 are provided to displace two slides 19 or 20 with the same spacing or to vary the spacing between two slides. This is necessary in order to be able to align the stencil 4 relative to the position and the width of the material to be printed located on a conveyor belt 40.

FIG. 2 shows that the transverse bar comprises two transverse bars, whereby one part is associated with one printing station and the other part with the adjacent printing station. By combining the two parts within section 15 space is saved. If in FIG. 1 transverse bar 6 represents the start or finish of the rotary screen process printing press, a new profile can be used therein instead of the double T section 15. As can be seen in FIG. 2, section 15 is provided with trays 36, 37, which provide better protection to the parts located therein.

An advantage of the printing press of the present invention is that when the contact between the screen block and the material to be printed is interrupted, it is only necessary to move small masses, i.e. the stencil and the moved parts of the head bearing. All other parts of the printing station are supported in a fixed manner on the machine frame. The driving shaft 22 provided in transverse bar 7 makes it possible to remove the drive from the area of stencil 4 and to protect the same in a satisfactory manner. Since the transverse bars 6 and 7 are fixed it is possible to walk on the rotary screen process printing press, if this is necessary. A conveyor belt 40 for carrying the material to be printed and a supporting beam 41 located below head bearing 5 are also shown in FIG. 2.

Figure 3:
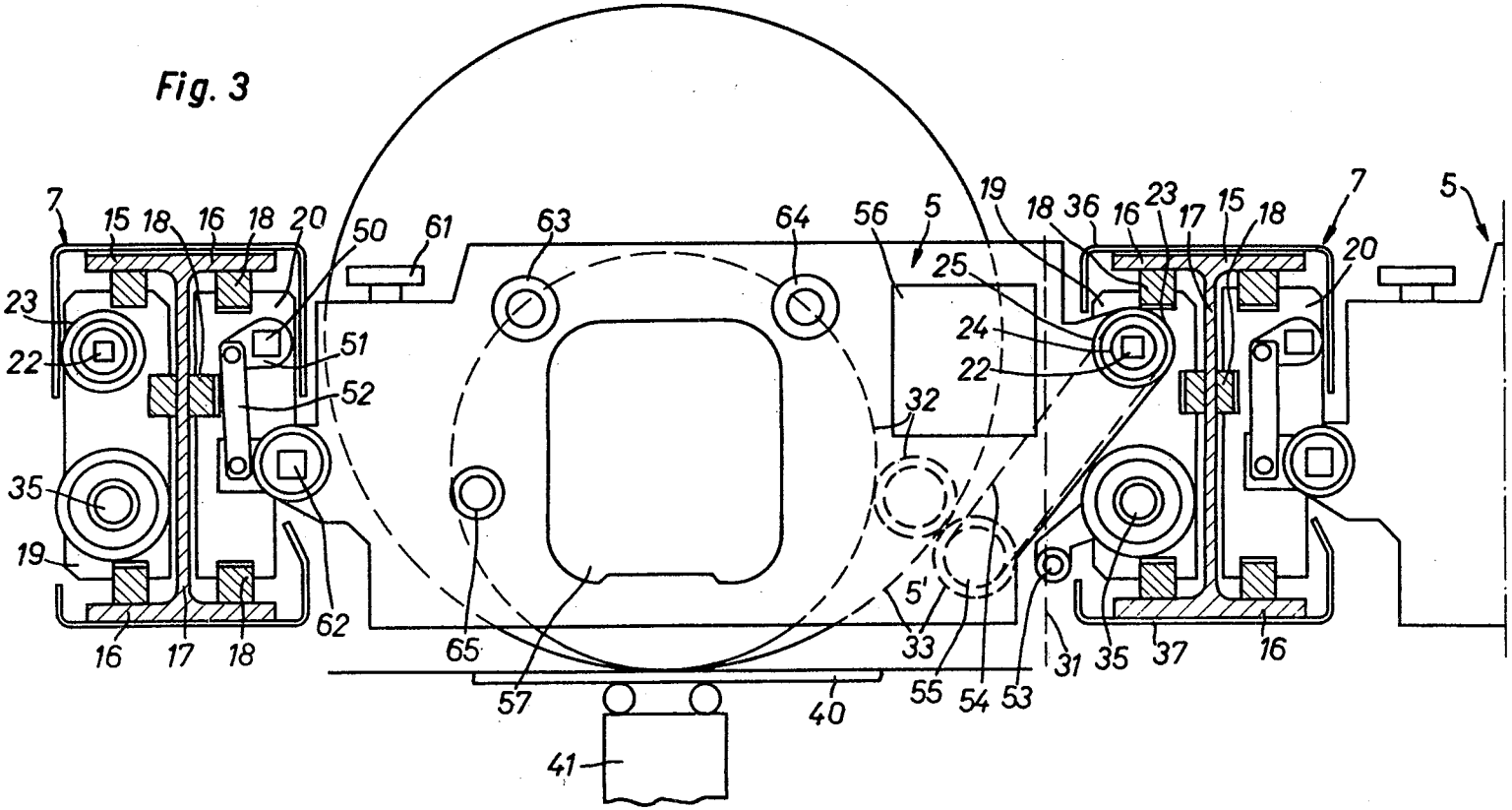
FIG. 3 is a schematic cross-sectional view of an alternative embodiment of the present invention.

FIG. 3 shows an alternative embodiment of the mounting system shown in FIG. 2. The reference numerals common to both FIGS. 2 and 3 represent identical parts and are consequently not mentioned again in connection with the description of FIG. 3. In place of the thrust piston drive 27 for raising head bearing 5 shown in FIG. 2, FIG. 3 shows a mechanical lifting mechanism in which the head bearing 5 is moved up and down by a rocking shaft 50 via a lever 51 and a flap 52. Slide 20, on which the head bearing 4 is supported, can be displaced together with parts 51 and 52 along rocking shaft 50. The same displacement possibility exists for slide 19, whereby head bearing 5 can be secured in the particular position by a clamping device 53 on spindle 35.

Gear wheel 23 is constructed as a wheel of a toothed belt drive, whose schematically represented toothed belt 54 drives a gear wheel 55, which in turn drives the pairs of wheels 32 and 33. The toothed belt drive is pivotable so that it can be arranged relative to the pairs of wheels used. A schematically shown blocking housing 56 serves to stop the pivotable toothed belt drive.

An opening 57 in head bearing 5 serves to introduce a doctor indicated by the reference numeral 60 in FIG. 1. On head bearing 5, an adjusting grip 61 is provided which permits the setting of the doctor angle by adjusting the doctor 60. By turning grip 61, a linkage (not shown) connected with doctor 60 is adjusted and therefore so is a shaft 62 extending over the width of the machine. On shaft 62 it is possible to displace, together with the head bearing, the linkage adjustable by grip 61 used for setting the doctor angle.

Further control grips 63, 64 are used to secure and remove the stencil 4 relative to head bearing 5. A bearing 65 for the linkage is provided for setting the doctor angle.

The alternative embodiment shown in FIG. 3 with the pivotable toothed belt drive 54, 55 is advantageous in that it permits the use of a wider variation in the diameter of the stencil than in the construction shown in FIG. 2.

While certain advantageous embodiments have been chosen to illustrate the invention, it will be understood by those skilled in the art that various changes and modifications can be made therein without departing from the scope of the invention as defined in the appended claims.

We claim:

1. A rotary screen process printing press having at least one printing station comprising
   - a machine frame;
   - a conveyor belt supported on said frame for carrying material to be printed;
   - said station having first and second transverse bars fixedly secured to said frame above said belt, said first bar having a driving shaft rotatably mounted therein to rotate about the longitudinal axis of said shaft;
   - a cylindrical stencil provided between said first and second bars;
   - a bearing plate mounted on each end of said stencil, first means for coupling one end of each bearing plate to said first bar to permit each bearing plate to pivot about said shaft axis, and second means for coupling the other end of each bearing plate to said second bar to raise and lower said other end of each bearing plate selectively whereby said stencil may be moved toward or away from the material to be printed to interrupt contact between said stencil and the material to be printed by pivotal movement of said bearing plates about said shaft axis upon actuation of said second means;
   - and driving means in one end of said bearing plates for coupling said stencil and said driving shaft to permit said driving shaft to rotate said stencil synchronously with said belt.

2. A rotary screen process printing press according to claim 1, wherein the press has a plurality of printing stations separated by a plurality of transverse members mounted on said frame;
   - each of said stations having a set of said first and second transverse bars and a cylindrical stencil mounted therebetween;
   - each transverse member forming the first bar of one station on one side thereof and the second bar of the adjacent station on the other side thereof.

3. A rotary screen process printing press according to claim 1, wherein said driving means comprises a belt which is pivotable about said driving shaft.

4. A rotary screen process printing press according to claim 1, wherein one of said bearing plates has an opening, a doctor is adjustably mounted in said opening to pivot in its adjusted position with said bearing plates.

5. A rotary screen process printing press according to claim 1 wherein said first and second bars each have slides adjustably mounted therein, said first and second means coupled to said slides, means for clamping said slides in position relative to said frame, whereby said bearing plates may be secured in a variety of positions.

* * * * *